United States Patent [19]

Heaton

[11] Patent Number: 4,555,903

[45] Date of Patent: Dec. 3, 1985

[54] INTERNAL COMBUSTION TURBINE ENGINE

[75] Inventor: William C. Heaton, Flomaton, Ala.

[73] Assignee: Ronald P. Howell, Brewton, Ala. ; a part interest

[21] Appl. No.: 597,495

[22] Filed: Apr. 6, 1984

Related U.S. Application Data

[60] Continuation-in-part of Ser. No. 400,071, Jul. 20, 1982, Pat. No. 4,449,488, which is a division of Ser. No. 157,517, Jun. 9, 1980, Pat. No. 4,344,288.

[51] Int. Cl.[4] ..... F02B 71/04

[52] U.S. Cl. ..... 60/595; 92/136; 92/138; 123/46 R; 123/61 R

[58] Field of Search ..... 123/46 R, 46 B, 58 R, 123/61 R, 62, 63, 197 AB, 197 AC; 92/136, 138; 60/595

[56] References Cited

U.S. PATENT DOCUMENTS 1,271,569 7/1918 Hancock ..... 92/136 X
2,814,551 11/1957 Broeze et al. ..... 123/46 R X

FOREIGN PATENT DOCUMENTS 693042 11/1979 U.S.S.R. ..... 123/46 B

*Primary Examiner*—Michael Koczo
*Attorney, Agent, or Firm*—Jones & Askew

[57] ABSTRACT

An internal combustion engine in which a rotor or turbine is driven by the exhaust gases of interconnected double acting pistons. The three parallel pistons are interconnected by pinion gears engaging racks on the sides of the pistons. Improved mechanisms are disclosed for coordination of the movement of the pistons, the manner in which the intake and exhaust valves are operated, the manner in which the engine is started, and the manner in which the firing of spark plugs is timed. A control wheel is provided for starting and valve operation. A cam connected to the pinion gears operates sets of points to fire the spark plugs.

8 Claims, 14 Drawing Figures

INTERNAL COMBUSTION TURBINE ENGINE

CROSS REFERENCE TO RELATED APPLICATION

This application is a continuation-in-part of application Ser. No. 400,071, filed July 20, 1982, now U.S. Pat. No. 4,449,488, which is a divisional application of Ser. No. 157,517, filed June 9, 1980, now U.S. Pat. No. 4,344,288.

DESCRIPTION

1. Technical Field

The present invention relates to internal combustion engines, and more particularly relates to an internal combustion engine utilizing the exhaust of interconnected double acting pistons to drive a turbine to provide rotary motive force.

2. Background Art

In the most commonly used type of combustion engine, such as the standard automobile engine, the drive shaft is rotated by converting the thrust of pistons into rotational motion of the drive shaft by a direct mechanical linkage in the form of connecting rods. The manner of conversion of the chemical energy of the fuel used to drive the pistons into rotational energy of the drive shaft in such engines lacks efficiency because a significant amount of the energy imparted by the exploding fuel to the thrust of the pistons is lost to friction and to poor leverage through the mechanical linkage. Standard piston engines use relatively large amounts of fuel, and cause well known air and noise pollution problems.

Turbine engines have been designed with the object of providing more efficient power plants. In some turbine engines, a mixture of air and fuel is compressed and ignited, and the expanding combustion gases are directed through a turbine that is connected to a drive shaft. Compression of the air/fuel mixture can be accomplished by means of reciprocating pistons, as shown in U.S. Pat. No. 3,710,569, issued to Rinker. In another turbine engine, shown in U.S. Pat. No. 3,068,639, issued to Benoit, a double acting piston is utilized to provide combustion gases to drive a turbine, but the structure of the engine shown in such patent is deficient in dynamic balance and coordination between the double acting pistons.

SUMMARY OF THE INVENTION

The present invention represents improvements on the concepts disclosed in my U.S. Pat. No. 4,344,288, particularly in the provision of three double acting pistons, the manner of coordination of the movement of the pistons, the manner in which the intake and exhaust valves are operated, and the manner in which the engine is started.

Generally described, the present invention comprises an internal combustion engine including an engine block defining a central cylinder and a pair of auxiliary cylinders positioned on opposite sides of the central cylinder; a central double acting piston slidably positioned within the central cylinder and a pair of auxiliary double acting pistons slidably positioned within the auxiliary cylinders, each of the pistons having a pair of racks mounted on opposite sides of the piston and being interconnected by double-sided pinion gears rotatably mounted on each end of a pair of shafts passing between the central cylinder and the auxiliary cylinders. The pinion gears thus simultaneously engage racks on both sides of adjacent pistons and regulate motion of the auxiliary pistons to motion at the same speed but in the opposite direction to that of the central poston.

Further coordination of the pistons is provided by a circular control wheel mounted adjacent to the block for rotation about an axis passing through the center of the central piston. The inner surface of the control wheel includes a circular rack. A pair of sprocket gears are positioned to engage the circular rack and are connected to the shafts of the pinion gears by articulated arms rigidly connected at one end to the pinion gear shaft and eccentrically rotatably connected at the other end to the sprockets. Thus, reciprocation of the double acting pistons causes the articulated arms to rotate the sprockets, which in turn rotate the control wheel. In order to start the engine, the process is reversed, that is, the control wheel is rotated to begin reciprocation of the pistons.

The control wheel also coordinates the operation of intake and exhaust valves located in cylinder heads associated with both ends of each of the double-acting pistons. Cams on the outer surface of the control wheel actuate rocker arms which engage valve stems of the valves to allow intake of air and fuel for combustion and to release combustion gases against the blades of the turbine.

Coordination of the internal combustion engine is also improved by means for interconnecting the pistons to the points which fire the spark plugs. The engine thus comprises an engine block defining therein a pair of parallel cylinders; double acting piston means slidably positioned within the cylinders; reciprocally rotatable means interconnecting the piston means for limiting the sliding movement thereof within the cylinders to reciprocation at the same speed in opposite directions; a cam mounted to reciprocally rotate with the interconnecting means; spark means at each end of each of the cylinders; a plurality of sets of points, each corresponding to one of the spark means, the points being mounted adjacent to the cam such that a first group of points is operated upon reciprocation of said cam in a first direction and a second group of points is operated upon reciprocation of the cam in a second direction; and means for connecting points to the corresponding spark means.

Thus it an object of the present invention provide an internal combustion engine that is quiet, clean and more efficient than previous internal combustion engines.

It is a further object of the present invention to provide an internal combustion engine in which improved dynamic balance and power are achieved by particular arrangement of double-acting pistons.

It is a further object of the present invention to provide an internal combustion engine having improved coordination of multiple double-acting pistons.

It is a further object of the present invention to provide an improved internal combustion engine of the type in which exhaust gases from reciprocating pistons drive a turbine.

Other objects, features, and advantages of the present invention will become apparent upon reading the following specification when taken in conjunction with the drawing and the appended claims.

DETAILED DESCRIPTION

Figure 1:
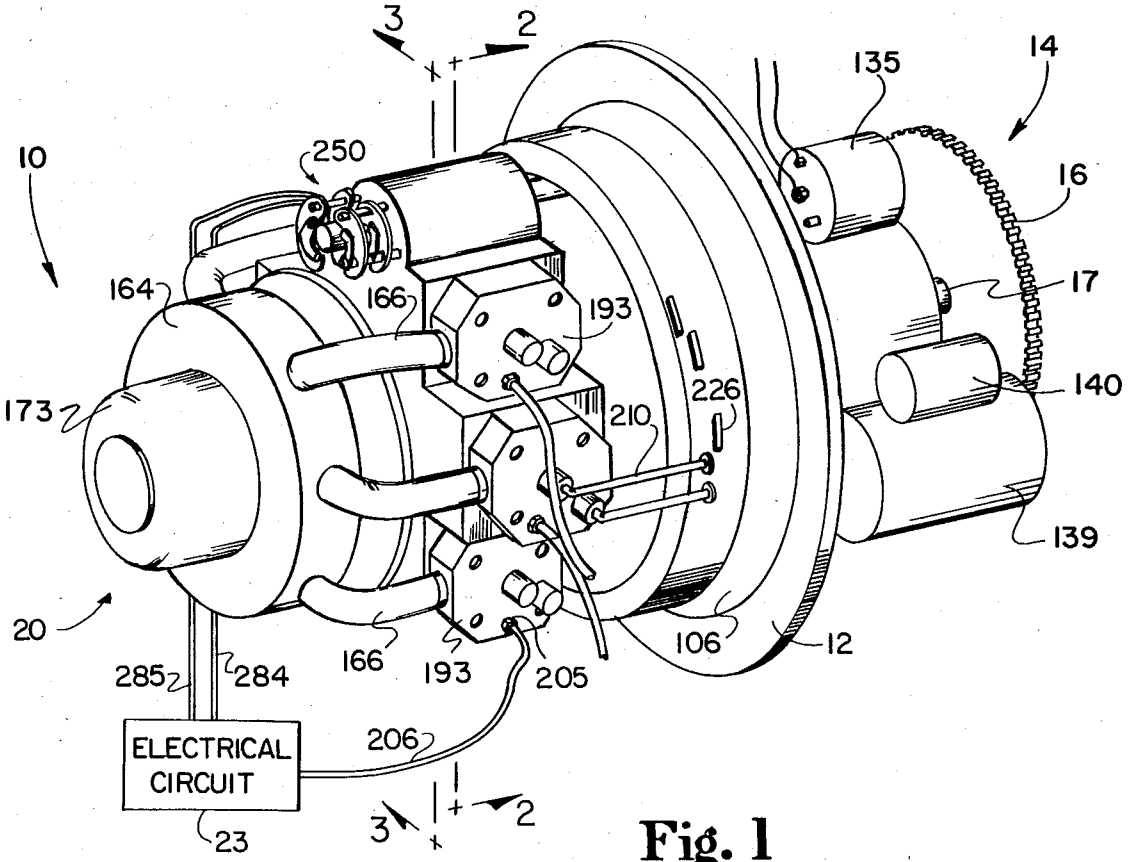
FIG. 1 is a pictorial view of an internal combustion engine embodying the present invention, with portions of the housing and turbine broken away.

Referring now in more detail to the drawing, in which like numerals represent like parts throughout the several views, FIG. 1 shows an internal combustion engine 10 embodying the present invention. The major components of the engine 10 include an enclosed, cylindrical, main housing 12, a starter assembly 14, a drive shaft 17 to which is attached a flywheel 16, a fuel and air input assembly 20, an electrical circuit 23, and an exhaust treatment assembly 22 as shown in FIGS. 2 and 3.

The housing 12 encloses an engine block 24 mounted on supports 25. Openings within the block include an upper auxiliary cylinder 26, central cylinder 27, and a lower auxiliary cylinder 28. Slidably mounted in a conventional manner within these cylinders are an upper main double-acting auxiliary piston 30, a central main double-acting piston 31, and a lower main double-acting auxiliary piston 32, respectively. The cylinders and pistons are formed so that the volume within the central cylinder at the ends of the central piston 31 is equal to the combined volumes at the ends of the auxiliary pistons 30,32. This proportioning of volumes results in dynamic balance when the pistons reciprocate.

Figure 3:
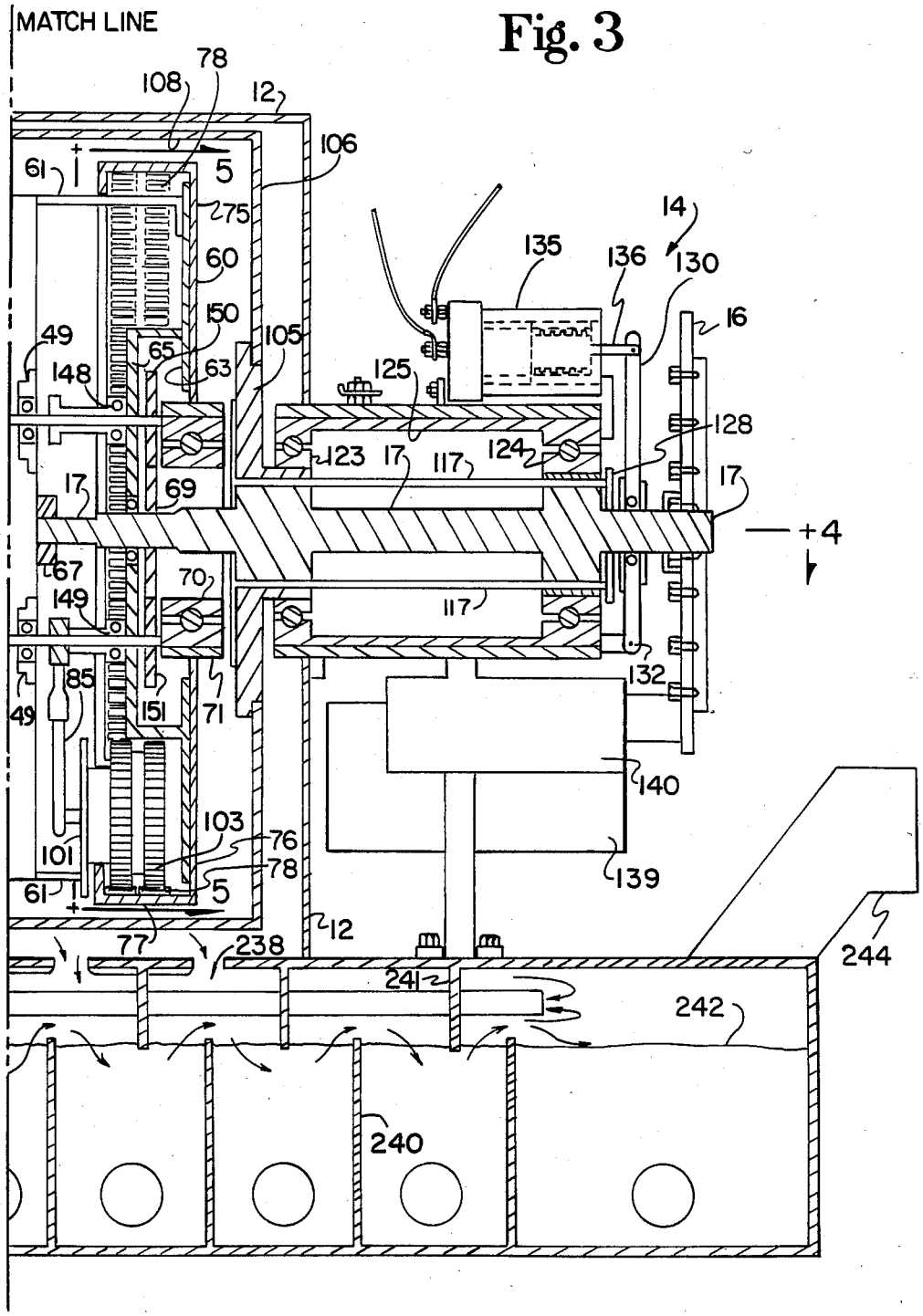
FIG. 3 is a longitudinal vertical cross sectional view of the engine of FIG. 1 taken along line 3—3 of FIG. 1.
Figure 3:
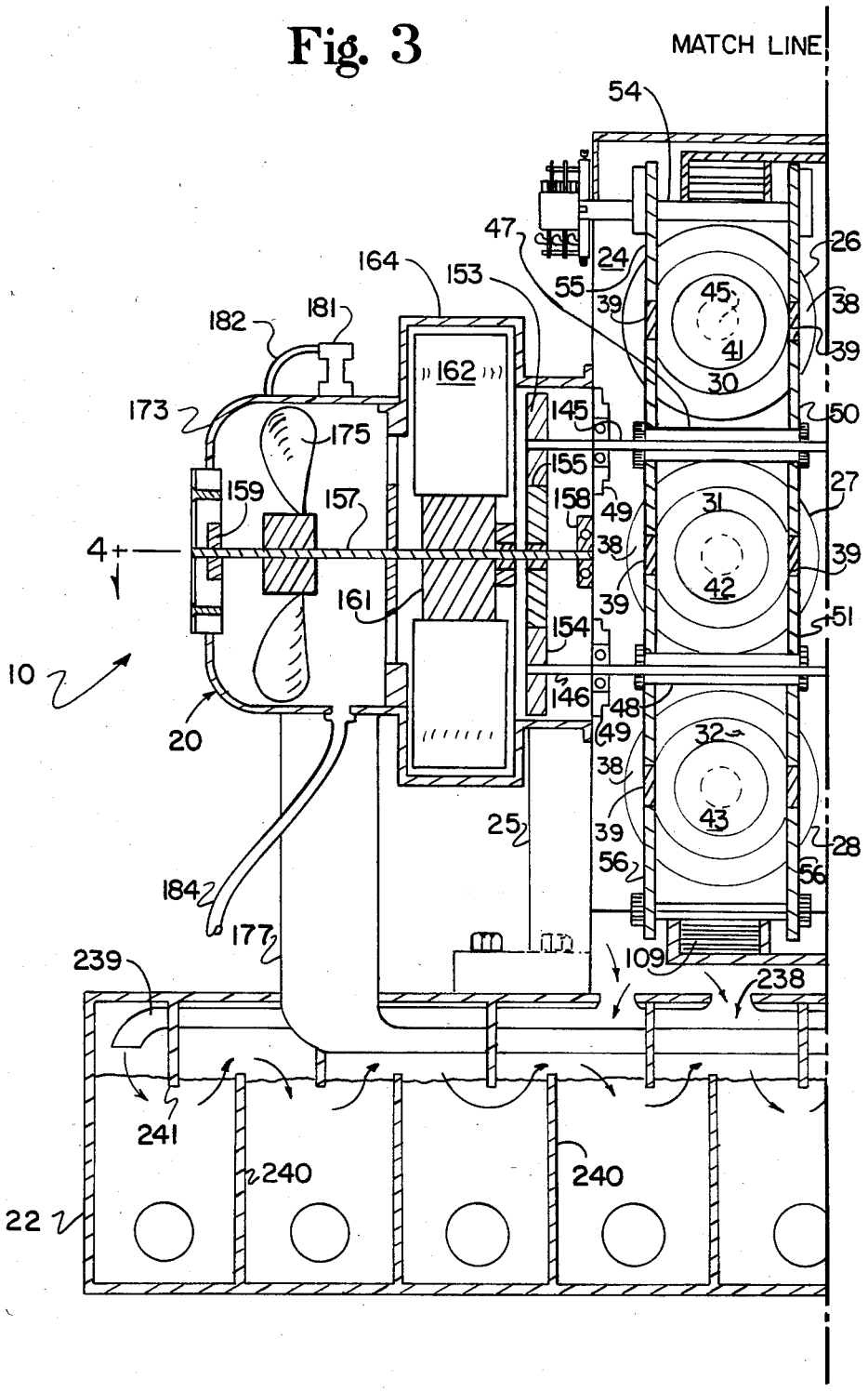
Figure 4:
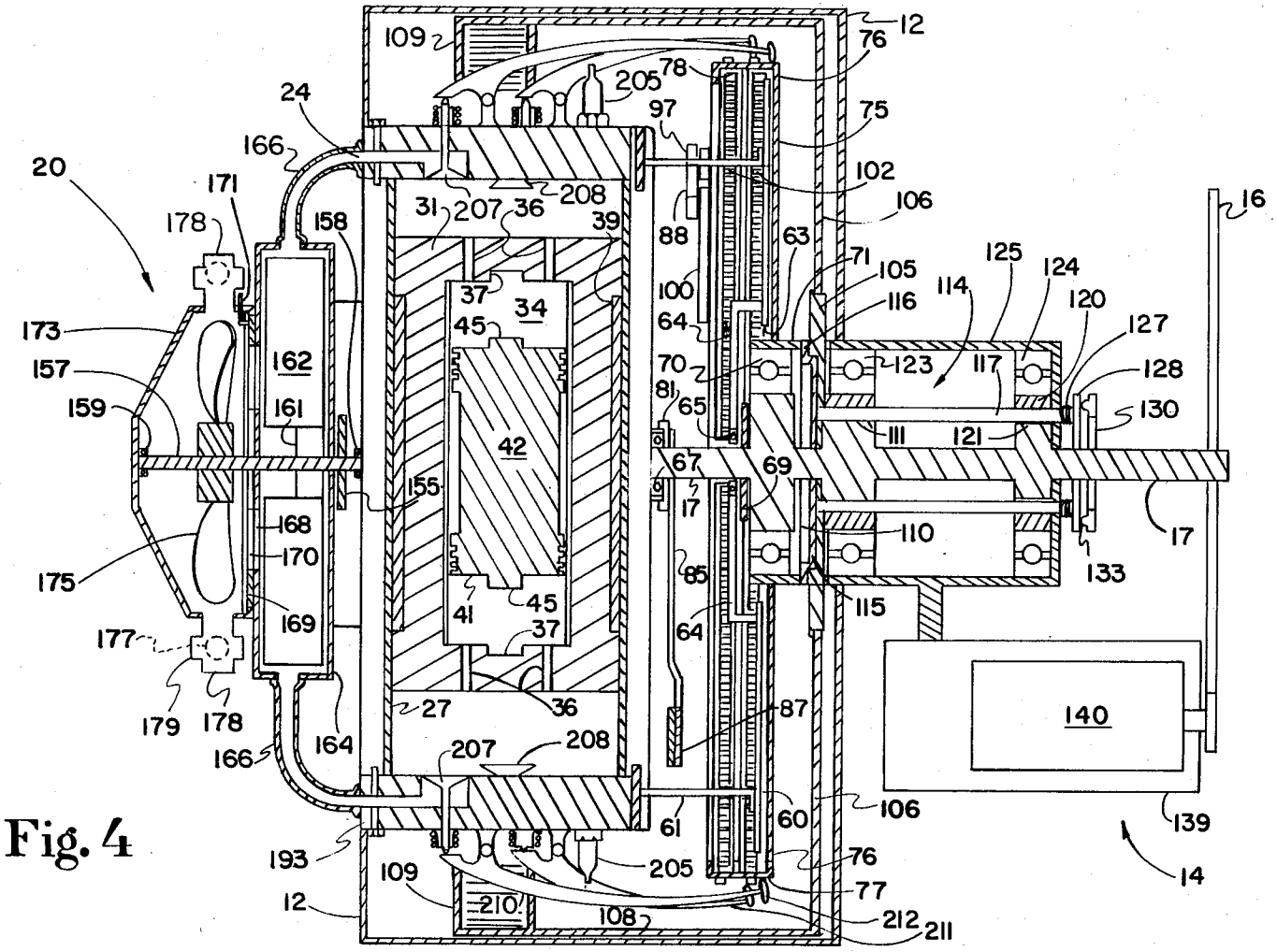
FIG. 4 is a horizontal cross sectional view of the engine of FIG. 1 taken along line 4—4 of FIG. 3.
Figure 5:
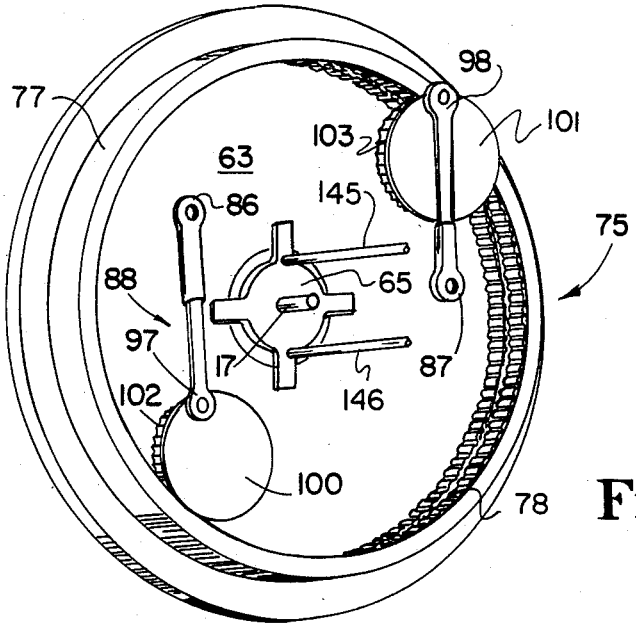
FIG. 5 is a transverse vertical cross sectional view of the engine of FIG. 1 taken along line 5—5 of FIG. 3.

Each double-acting piston 30,31,32 also defines an inner cavity 34, as shown in FIG. 4. Within the respective inner cavities are slidably mounted an upper inner piston 41, a central inner piston 42, and a lower inner piston 43, shown in FIG. 3. The inner pistons 41,42,43 are also double-acting pistons, and each include projections 45 at both ends, the projections 45 being received in pockets 37 formed in the end walls of the inner cavities 34 of the main pistons. The pockets 37 are formed slightly larger than the projections 45 so that the impact of the inner pistons against the end walls of the inner cavities is cushioned as the projections enter the pockets. The inner cavities 34 communicate with the cylinders 26,27,28 through a plurality of bores 36. Preferably six bores 36 are provided in each end of the main pistons.

Figure 2:
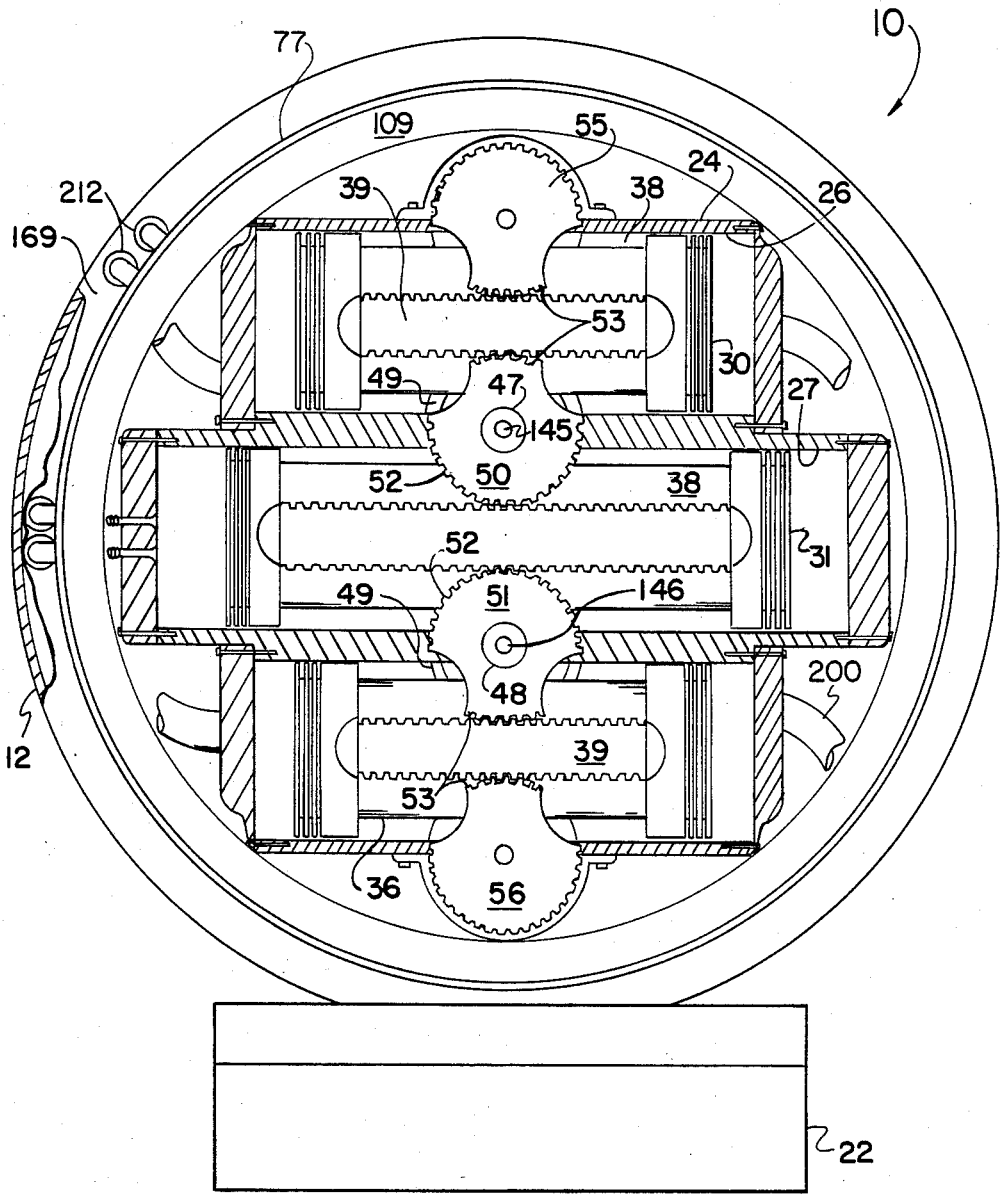
FIG. 2 is a transverse vertical cross sectional view of the engine of FIG. 1 taken along line 2—2 of FIG. 1.

As best shown in FIGS. 2 and 3, each of the main pistons 30,31,32 has an annular recess 38 cut away from a central portion of the outer circumference of the piston. Within this recess 38 on opposite sides of each main piston an elongate rack is fixed to the exterior of the piston. A pair of hollow shafts 47 and 48 are positioned in openings in the block between the cylinders perpendicular to the cylinders, and are supported by bearings 49 attached to the block. The racks of each adjacent main piston are interconnected by pairs of pinion gears 50,51. Upper pinion gears 50 engage a rack of upper main piston 30 and the corresponding rack on the same side of central main piston 31. The upper pinion gears 50 are rotatably mounted on shaft 47. Similarly, lower pinion gears 51 engage a rack of lower main piston 32 and the same racks of central main piston 31. The lower pinion gears are rotatably mounted on shaft 48. All four of the pinion gears 50,51 have a long arcuate toothed edge 52 for engaging the rack of the central piston, and a short arcuate toothed edge 53 for engaging the rock of one of the auxiliary pistons. It will be seen that the pinion gears 50,51 restrict motion of the main pistons such that the auxiliary pistons move at the same speed but in the opposite direction as the central piston.

Idler pinion gears 55,56 similar to the pinion gears 50,51 are mounted on idler shafts 54 positioned above the upper main piston 30 and below the lower main piston 32, and are provided to engage the racks of the auxiliary pistons 30,32 to provide balance and support. One of the shafts 54 also operates the timing mechanism of the engine in a manner as described below.

Referring to FIGS. 3 and 4, a circular plate 60 is mounted in spaced apart relation to the block 24 by a plurality of horizontal brackets 61. The plate 60 defines a large central opening 63 which is straddled by a four-legged bracket 64 extending toward the block a portion of the distance between the plate 60 and the block. The bracket 64 supports a bearing 65 at its center aligned with the center of the block. On the same axis, a bearing 67 is supported on the block, and the drive shaft 17 passes through and is supported by the bearings 65 and 67. Between the bracket 64 and the plate 60, the drive shaft 17 carries a small circular gear 69, the purpose of which is explained below.

Adjacent to the gear 69, the drive shaft 17 carries a large bearing 70 which is freely operable within the opening 63 in the plate 60. The bearing 70 includes an annular lip 71 extending away from the block, and four spaced apart notches 72 in the lip 71 which form part of the starting linkage 14 explained below. A control wheel 75 is carried by the bearing 70 and thus is rotatable about the drive shaft 17. The control wheel 75 includes at its outer periphery a cylindrical member which defines a cam surface 77 on its outer surface and an inner cylindrical or ring gear 78 on its inner surface.

Figure 8:
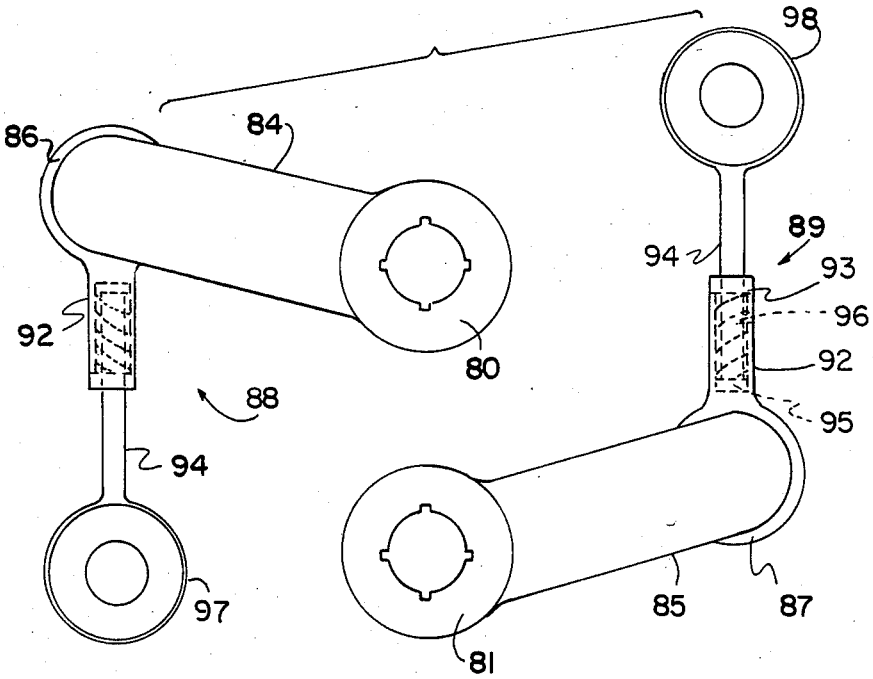
FIG. 8 is an enlarged plan view of an articulated arm of the assembly of FIG. 7.

Referring to FIGS. 3, 4, 7 and 8, the pistons and pinion gears are connected to the control wheel 75 by an assembly now to be described. The shafts 47 and 48 terminate in hubs 80 and 81, respectively. A crank arm 84 is rigidly attached to the hub 80 and extends in the space between the block 24 and the control wheel 75 generally parallel to the plane of the control wheel. At the extending end of the crank arm 84, a bearing 86 rotatably connects the arm 84 to a connecting arm 88. As shown in FIG. 8, the connecting arm 88 is extendable. A hollow cylinder 92 adjacent to the bearing 86 receives an arm 94 which defines a flange 95 on its end extending into the cylinder 92. A compression spring 96 surrounds the arm 94 within the cylinder 92, and is retained between the flange 95 and a cap 93 which encloses the cylinder 92 but includes a bore allowing the arm 94 to move in and out of the cylinder 92.

The articulated arm assembly formed by the arms 84,88 is rotatably connected at the extending end of the arm 94 by a bearing 97 to a drive wheel 100 at an eccentric point on the drive wheel 100. The drive wheel 100 supports a concentric sprocket 102, which is preferably a double sprocket engaging the inner cylindrical gear 78, which can be a double chain fixed to the inner surface of the cylinder 76 of the control wheel 75.

A second articulated arm assembly is formed by a crank arm 85 connected to a hub 81 on the shaft 48, the crank arm 85 being connected by a bearing 87 to a connecting arm 89, which is in turn connected by a bearing 98 to a drive wheel 101 supporting a sprocket 103 engaging the inner cylindrical gear 78 of the control wheel 75. The gear ratio between the the gear 78 and the sprockets 102,103 is 5:1 for operation of the valves in the manner shown in FIG. 12. That is, each of the sprockets rotates 5 times in rotating the control wheel one time. The ratio can also be 3:1, which would require a corresponding change in placement of cams on the cam surface 77.

Adjacent to the bearing 70, an annular drive collar 105 is fit onto the drive shaft 17. A drive disc 106 is attached to the outer periphery of the collar 105 and extends radially outwardly to a point outside the control wheel and block. From the drive disc 106, a cylindrical turbine support member 108 extends over the control wheel 75 to a point over the center of the block 24, where the member 108 supports an annular turbine 109. The turbine 109 surrounds the block and lies in the plane of the cylinders 30,31,32, in order to receive exhaust gases.

Figure 6:
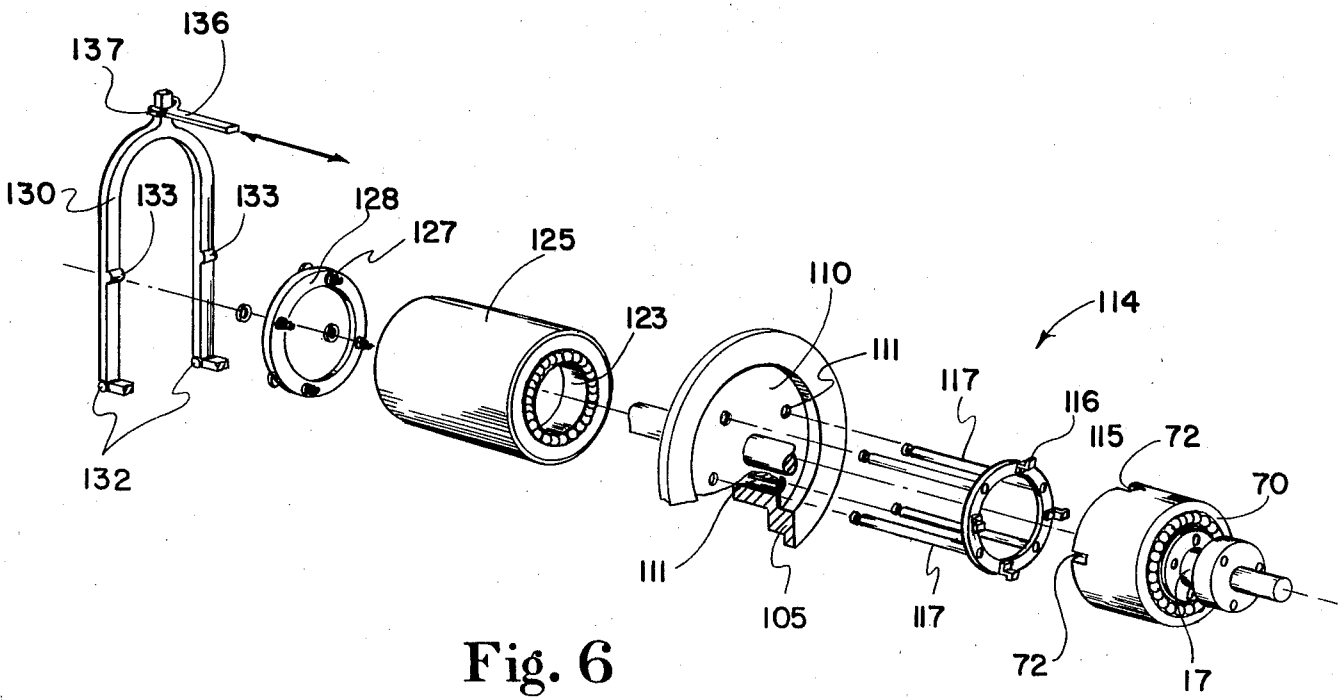
FIG. 6 is an exploded view of the starter linkage of the engine of FIG. 1.
Figure 7:
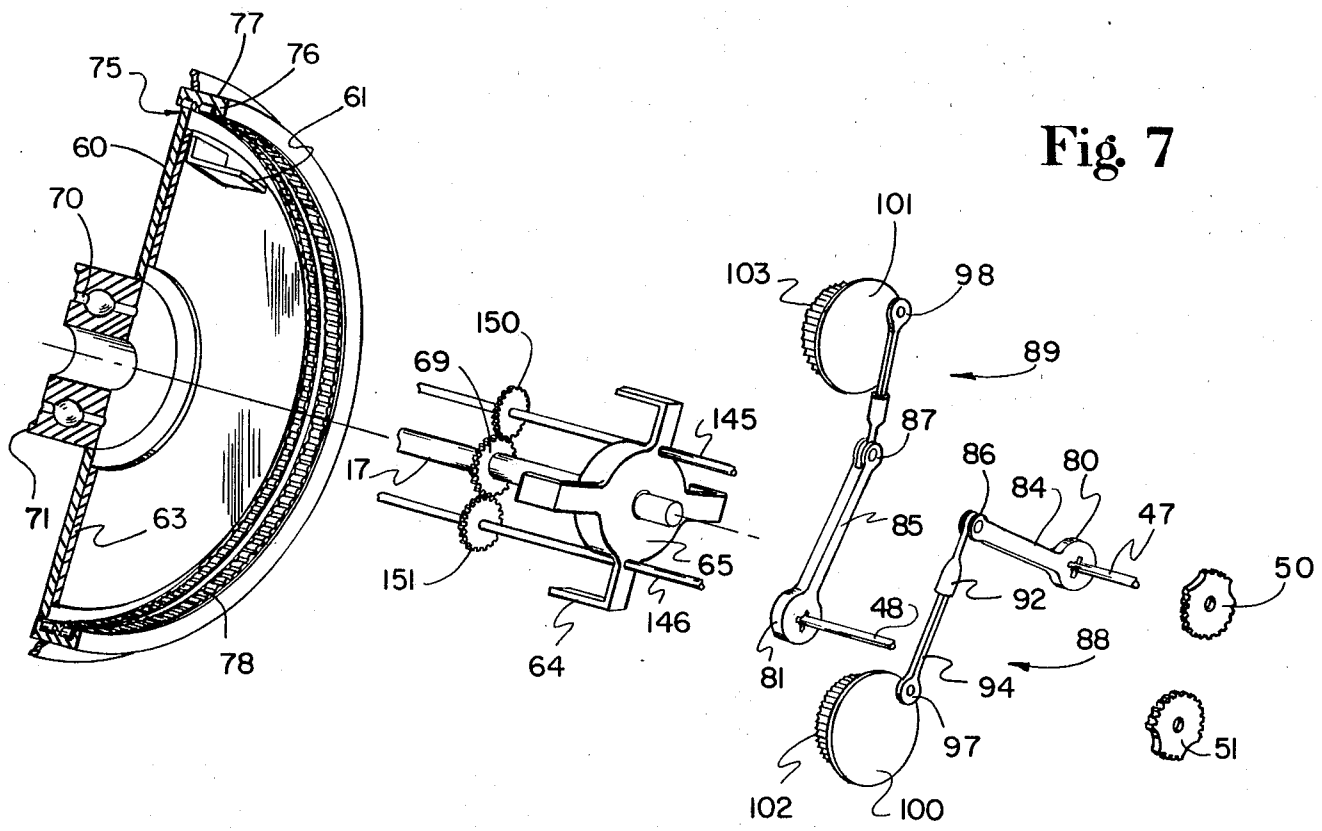
FIG. 7 is an exploded view of the control wheel assembly of the engine of FIG. 1.
Figure 9:
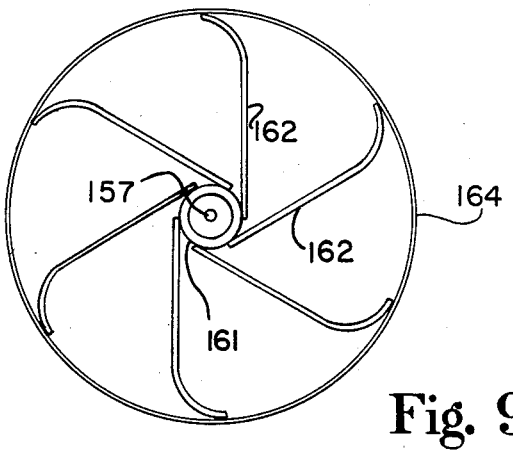
FIG. 9 is a plan view of the air pump.

The starter assembly 14 is best shown in FIG. 6. The collar 105 defines a circular recess 110 facing the bearing 70. Four bores 111 extend from the bottom of the recess 110 parallel to the drive shaft 17, through the remainder of the collar 105. During assembly of the drive shaft, collar, and bearing 70, a starter plunger 114 is positioned between the collar 105 and the bearing 70. The plunger 114 comprises a ring 115, four fingers 116 extending outwardly from the ring, which fits in the recess 110, and four posts 117 extending from the ring through the bores 111. The fingers 116 are positioned to mate with the notches 72 in the lip 71 of the bearing 70, when the starter linkage is actuated as described below.

Another collar 120 is fit onto the drive shaft 17 spaced apart from the collar 105. The collar 120 defines bores 121 colinear with the bores 111. The posts 117 also pass through the bores 121. The collars 105 and 120 both carry annular bearings 123 and 124, respectively. A starter linkage housing 125 is fixed to the outer race of these bearings and is also fixed to main housing 12. Thus, the drive shaft 17 and the starter plunger 114 can rotate together within the housing 125. Compression springs 127 are placed over the ends of the posts 117 where they emerge from the collar 120. A cap ring 128 snaps over the ends of the posts 117 to retain the springs, which then normally urge the ring 115 and fingers 116 into the recess 110. An actuator linkage 130 is positioned adjacent to the end of the housing 125, and is pivotally connected to the lower part of the housing 125 by pivot pins 132. At the level of the drive shaft 17, a pair of tabs 133 extend from the linkage 130 to engage the cap ring 128. A solenoid 135, shown in FIG. 3, is mounted on top of the housing 125 and includes a piston rod 136 pivotally attached at its extending end to the top of the linkage 130 at 137. When the solenoid is activated, the rod 136 is drawn into the solenoid, causing the linkage 130 to move the plunger 114 toward the bearing 70 until the fingers 116 enter the notches 72, effectively connecting the drive shaft 17 to the control wheel 75 until the solenoid is deactivated.

A starter motor 139 is provided on the housing 12 adjacent to the flywheel 16. A solenoid 140 is provided to selectively engage the starter motor to the toothed periphery of the flywheel in a conventional manner. Operation of the starter motor and solenoid 140 rotates the flywheel for starting purposes using power from a battery (not shown).

Referring now to FIG. 3, shafts 145 and 146 extend through the hollow shafts 47 and 48, respectively. Shafts 145 extends through a bearing 148 mounted on the bracket 64 into the space between the bracket 64 and the plate 60. Attached to the end of the shaft 145 is a circular gear 150 which meshes with the gear 69 on the drive shaft 17. The other end of the shaft 145 extends out of the other side of the block 24 and carries a circular gear 153. Similarly, the shaft 146 passes through a bearing 149 and carries a gear 151 which meshes with the gear 69. The other end of the shaft 146 carries a gear 154 identical to the gear 153 and spaced apart therefrom. A gear 155 lies between and meshes with both gears 153 and 154. The gear 155 is mounted on a shaft 157, supported by a bearing 158 on the block 24 and by a bearing 159 on a mixer housing 173.

The shaft 157 passes through an air pump housing 164, which encloses an air pump comprising a hub 161 fitted onto the shaft 157, and curved blades 162 extending from the hub 161. Intake manifolds shown best in FIG. 4 extend from the air pump housing 164 to the cylinders. The shaft 157 also passes through the mixer housing 173, which is separated from the air pump housing by a plate valve 169. The valve 169 includes a plurality of openings 170 positioned at equal radial distances from the shaft 157, about which the valve 169 can rotate. The wall of the air pump housing 164 also includes a plurality of openings 168 at the same distance from the shaft. Rotation of the valve 169 by means of a control rod 171 (which passes out of the mixer housing) selectively varies alignment of the openings 168 and 170 to control the amount of fluid flow into the air pump housing. Mounted on the shaft 157 within the mixer housing 173 is a mixer 175 which atomizes fuel emitted into the housing 173 by a fuel jet 181. Air to be mixed with the fuel enters from recirculation conduits 177 from the exhaust treatment assembly 22. Fresh air can be admitted through valved inlets 178 and mixed with the recirculated gases in mixing chambers 179 prior to entering the mixer housing 173. Fuel is provided to the fuel jet through a fuel line 182. A drain line 184 attached to the bottom of the mixer housing 173 conducts any liquid accumulating in the housing 173 into the exhaust treatment assembly 22.

Figure 10:
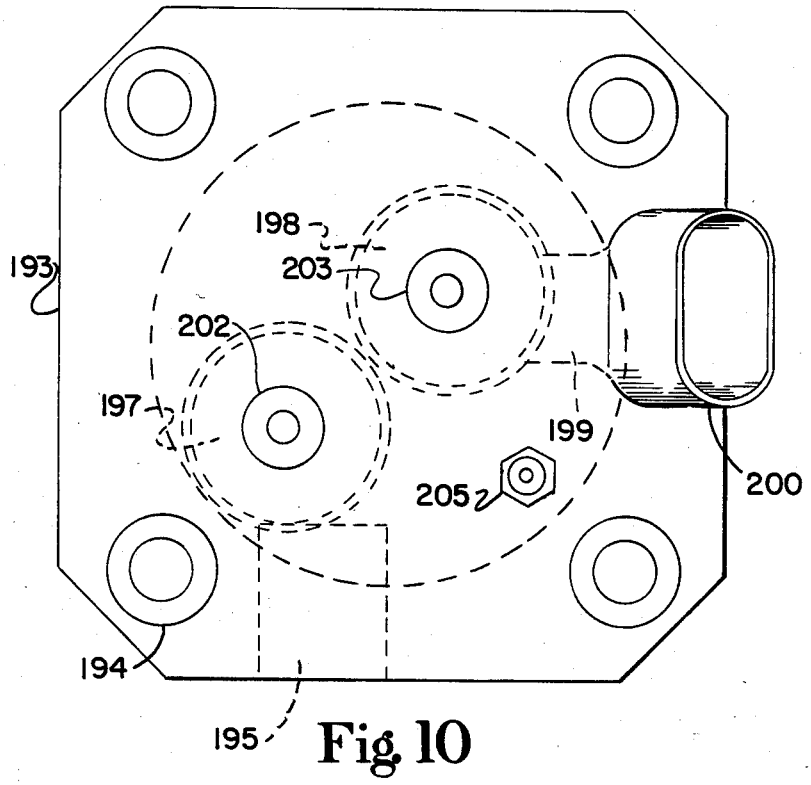
FIG. 10 is a plan view of a cylinder head.
Figure 11:
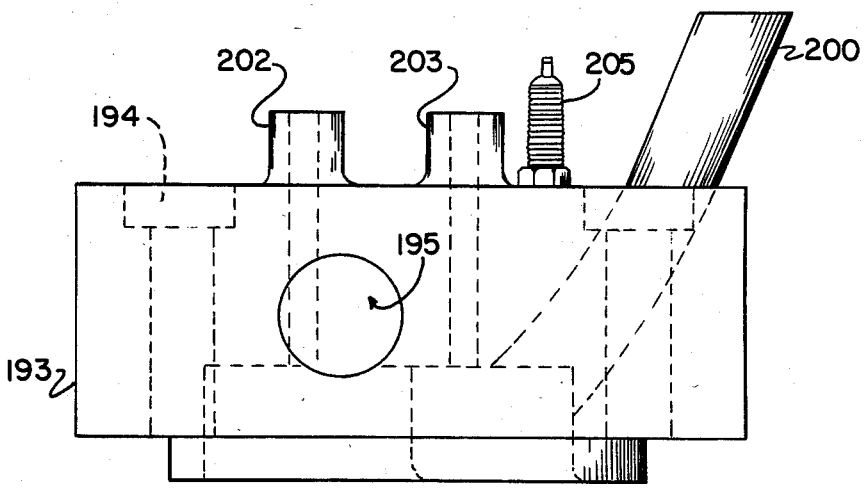
FIG. 11 is a side view of a cylinder head.

With reference to FIGS. 4, 10 and 11, each end of each of the cylinders 26,27,28 is enclosed by a head 193. As the heads are generally similar, only one will be described in detail. Each head is secured to the block 24 at the corners of the head by bolts 194. An intake port 195 is bored into the side of the head facing the intake manifold 166, which is attached to the head at the port 195. An intake valve bore 197 and an exhaust valve bore 198 extend into the head from the cylinder. An exhaust port 199 connects the exhaust valve bore 198 to the exterior of the head, where the port 199 is extended by an exhaust conduit 200 to release gases adjacent to the turbine 109. An intake valve guide 202 and an exhaust valve guide 203 project outside the head to support valve stems 207,208 extending through small bores from the intake and exhaust valve bores. A spark plug 205 extends into the head to ignite gases within the cylinder. The spark plug is connected to the electrical circuit 23, shown diagrammatically in FIG. 1, by a lead 206. The circuit 23 is conventional and therefore is not shown in full. The circuit 23 includes conventional elements such as a battery, coils, and condensers. Improvements in the electrical system regarding the points and the number of coils and condensers are described below.

A rocker arm 210 is pivotally mounted on the exterior of the head with one end engaging the extending valve stem of the intake valve 207 and the other end terminating in a cam follower 212 which is actuated by cams on the control wheel 75, as shown in FIG. 4. Similarly, a rocker arm 211 actuates the exhaust valve 208.

Figure 12:
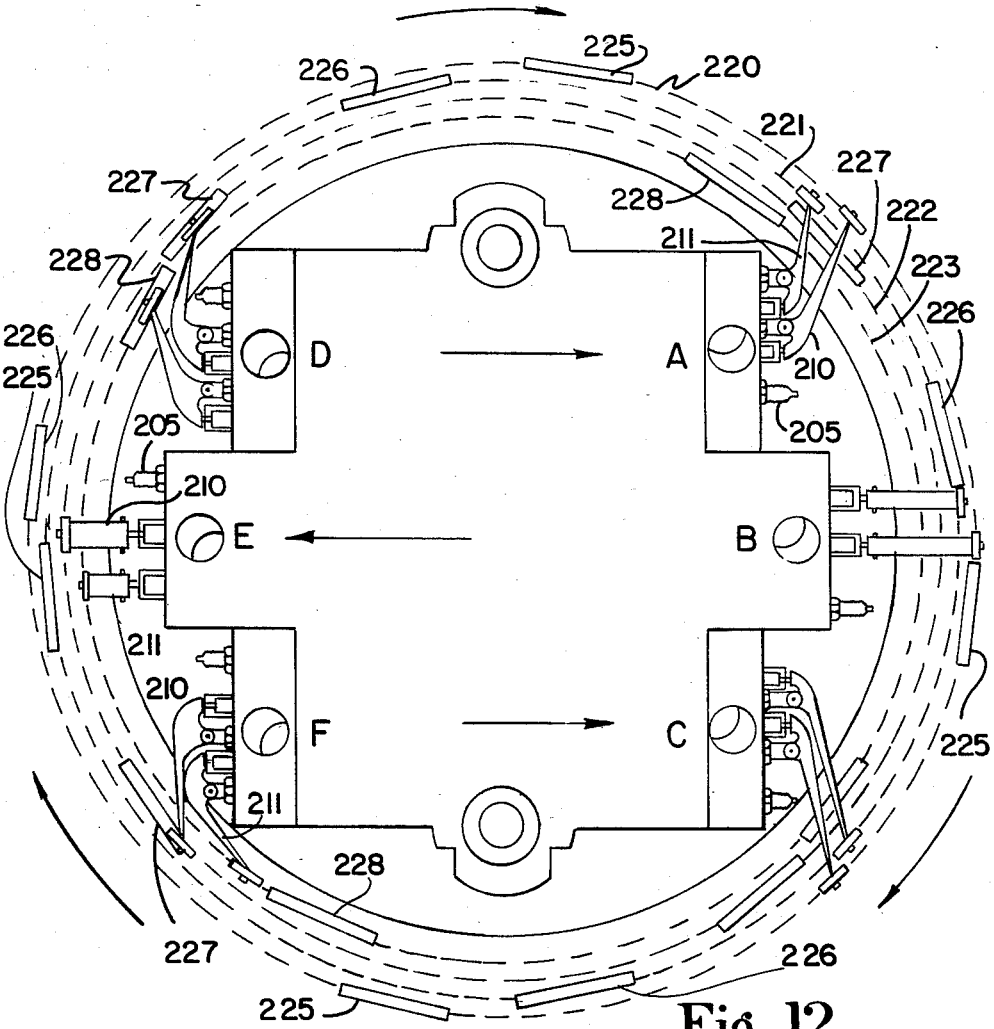
FIG. 12 is a diagrammatic view of the position of cams on the control wheel.

The position of cams on the control wheel 75 is shown diagrammatically in FIG. 12, in which the control wheel moves clockwise. The cam surface 77 of the control wheel has four circular cam tracks 220,221,222,223, with track 220 positioned farthest from the block and track 223 nearest the block. Cam tracks 220 and 221 include cams 225 and 226 which operate valves for combustion zones A,B,C, that is, combustion at the right ends of the cylinders 26,27,28, respectively, as viewed in FIG. 12. Cam tracks 222 and 223 include cams 227 and 228 which operate valves for combustion zones D,E,F at the left of the cylinders. The cams 225,226 and 227,228 are arranged in pairs in their respective can tracks, with each pair 90 degrees apart from an identical pair, and with an opposite pair being positioned midway between. As shown in FIG. 12, a 225,226 pair is at least 0 degrees, 90 degrees, 180 degrees, and 270 degrees. A 227,228 pair is located at 45 degrees, 135 degrees, 225 degrees and 315 degrees. Within each pair, the cams which operate the exhaust valve (225 or 227) are advanced ahead of the cams which operate the intake valve (226 or 228). The cam pair reaches the combustion zone as the spark plug fires, so that the power of the exhaust gases is first connected to the exhaust conduit, and then the intake valve is opened as the piston retracts.

It should be noted that the cam pairs are positioned so that as the combustion zone E is associated with the central cylinder is firing, the valves for zone E are operated along with those for zones A and C. Similarly, zone B valves are operated only along with zones D and F. This preserves dynamic balance of the system.

Figure 13:
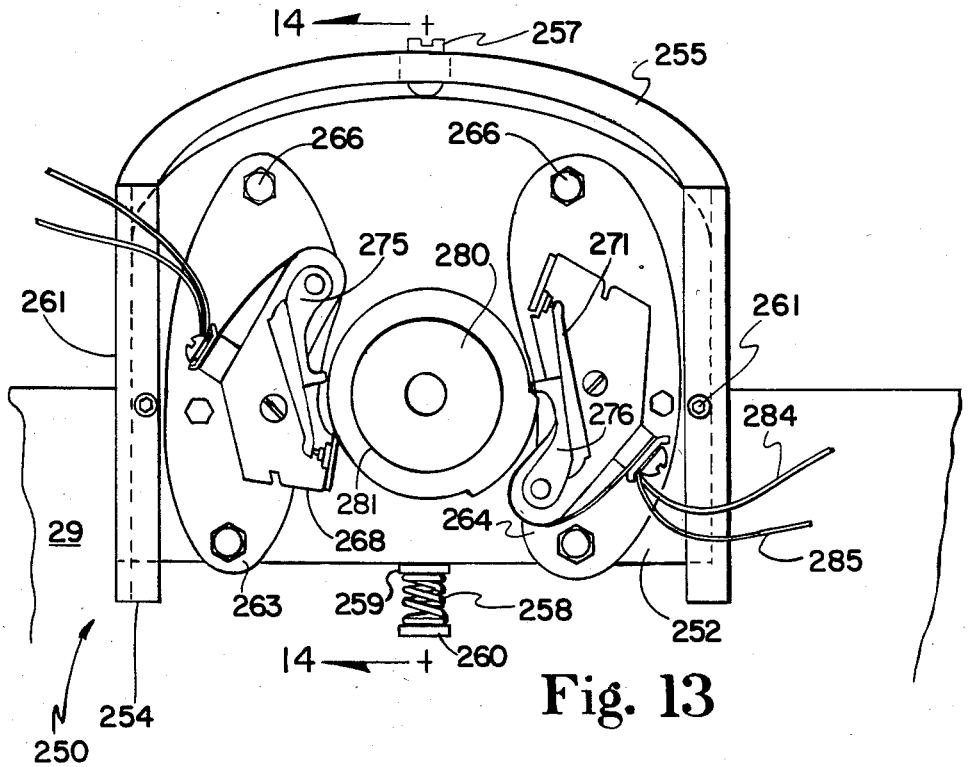
FIG. 13 is a front plan view of the timing mechanism of the engine of FIG. 1.
Figure 14:
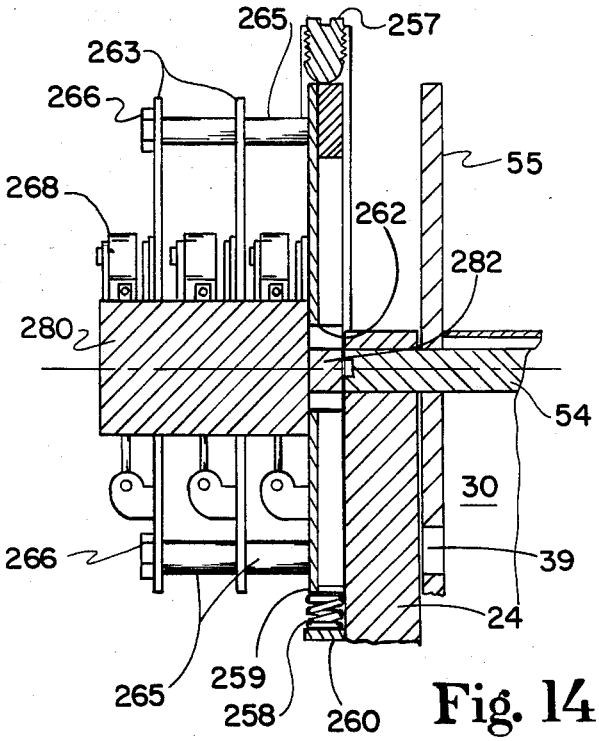
FIG. 14 is a vertical cross sectional of the timing mechanism taken along line 14—14 of FIG. 13.

Because of the extra load placed on the electrical circuit by the simultaneous firing of spark plugs, heavy duty distributors, condensers and the like are required, or, preferably, multiple sets of distributors, points and condensers can be used. FIGS. 13 and 14 show in detail a timing mechanism 250 for the engine 10. The timing mechanism 10 advantageously interconnects the firing of the spark plugs 205 with the actual position of each of the pistons 30,31,32. A mounting plate 252 is slidably positioned at the front of the engine block 24, as shown in FIG. 1, by a pair of brackets 254, which are fixed to the block 24 and define a channel shown in dotted lines in FIG. 13. The plate 252 fits within this channel, and rests upon a compression spring 258 which is attached to a block 260 extending from the engine block 24 and is received by a pin 259 extending downwardly from the plate 252. The brackets 254 are connected above the plate 252 by a connecting support 255. An adjusting screw 257 is threaded vertically through the support 255 and engages the top of the plate 252. By turning the screw 257 against the upward pressure of the spring 258, the vertical position of the plate 252 can be altered in order to advance or retard the timing of spark plug firing in a manner that will become apparent from the following description.

The plate 252 defines a central opening 262 therein aligned with the idler shaft 54. To the left of the opening 262 as viewed in FIG. 13, a pair of left point support plates 263 are held in spaced apart relation from each other and from the mounting plate 252 by spacers 265. Bolts 266 pass through the plates 263 and spacers 265 to fix the point support plates 263 to the engine block 24. Three sets of conventional points 268,269,270 are mounted on the plates 252,263 with their cam followers 275 facing the opening 262. A similar assembly is positioned on the right side of the opening 262, including right point support plates 264 and point sets 271,272,273 having cam followers 276 facing the opening 262. As shown in FIGS. 13 and 14, a cylindrical cam 280 is positioned between the left and right sets of points. The cam 280 includes a raised portion 281 which engages all of the left cam followers 275 when the raised portion 281 is rotated clockwise, and engaging the right cam followers 276 when the raised portion is rotated counterclockwise, the latter position being shown in FIG. 13. The cam 280 defines a neck portion 282 which passes through the opening 262 in the plate 252, and is attached to the end of the idler shaft 54, as shown in FIG. 14. Thus, movement of the idler shaft along with the pistons oscillates the cam 280.

Each set of points 268–273 is connected to a coil lead 284 and to a condenser lead 285 in a convention manner. However, the connection of the condensers and coils (not shown) to particular sets of points and to spark plugs of particular cylinder heads is essential. In order to assure the combustion zone E is firing along with zones A and C, the spark plug for zone E must be connected to a set of points on the opposite side from the sets of points connected to spark plugs of zones A and C. This also holds true for the relationship of zone B to zones D and F. An example of proper connection would be left points 268 and 270 connected to zones D and F, left points 269 connected to zone E, right points 271 and 273 connected to zones A and C, and right points 272 connected to zone B.

The raised portion 281 of the cam 280 is shaped and positioned on the cam 280 such that the respective points are engaged and opened when the pistons reach top dead center of the proper end of the cylinders, corresponding to the combustion zones as described above.

Operation of an internal combustion engine 10 according to the present invention begins by starting the engine. The solenoids 135 and 140 are activated, causing the fingers 116 to be inserted into the notches 72, whereby rotation of the flywheel 16 and drive shaft 17 by the starter motor 139 will also rotate the control wheel 75. Rotation of the control wheel 75 causes the sprockets 102 and 103 to rotate, which causes the eccentrically connected arms 88 and 89 to reciprocate, which, through the crank arms 84 and 85, and the pinion gears 50 and 51, causes the pistons 30, 31, and 32 to reciprocate. Rotation of the drive shaft 17 also results in rotation of shafts 145, 146 and 157, which causes mixing of fuel and air, and pumping of the mixture through the intake manifolds 166 into the cylinders through the intake valves, which will be opened at the proper time as a result of the interconnection of the control wheel 75 with the pistons.

Reciprocation of the pistons causes the idler shaft 54 and the cam 280 to reciprocate. Thus, as the central piston reaches one end of the central cylinder and the auxiliary pistons reach the opposite end of the auxiliary cylinders, the appropriate group of points is simultaneously opened by the cam 280, causing the proper spark plugs to fire in a conventional manner. The timing can be easily advanced or retarded by turning the screw 257, which changes the rotational position at which the raised portion 281 of the cam 280 engages the cam followers of the points.

Firing of the spark plugs creates exhaust gases which are conducted to the turbine 109, turning it. Rotation of the turbine and drive disc 106 turns the drive shaft 17. When the drive shaft reaches sufficient speed, the solenoid 135 is deactivated, allowing the springs 127 to withdraw the fingers 116 from the notches 72 in the bearing 70. The starter motor is also deactivated.

Now the engine is running, with the auxiliary cylinders firing at one end of the block when the central cylinder is firing at the other end of the block. Since the control wheel has been disconnected from the drive shaft, it rotates independently of the turbine, but in coordination with the reciprocation of the pistons, so that the valve operating cams always operate the rocker arms and the valves at the proper times. Whereas during starting the control wheel was rotating the sprockets, now the sprockets rotate the control wheel, which carries the cams.

During the power stroke of each piston, the inner piston 41,42,43 will compress gases within the inner cavity 34 and eject them through the bores 36 into the combustion zone. On the intake stroke, the reverse movement of the inner piston will draw gases into the inner cavity for compression on the next power stroke.

Exhaust gases pass through the turbine and within the housing 12 down into the exhaust treatment area 22. The suction created by the atomizer 175 and air pump 162 pulls the gases through fluids which cleanse the gases prior to recirculation through conduit 177. As shown in FIG. 3, the exhaust treatment area 22 comprises a tank which includes a plurality of lower baffles 240 which extend across the tank 22, and a plurality of upper baffles 241 extending across the tank parallel to the lower baffles 240. The baffles 240 extend from the bottom of the tank and end before meeting the top of the tank. The upper baffles 241 extend downwardly from the top of the tank between the lower baffles to a point below the uppermost extent of the lower baffles. The tank is filled with a fluid 242 to a level just immersing the ends of the upper baffles 241, the fluid 242 being a cleansing fluid such as a mixture of nine parts water to one part soluble oil. Removable plugs 243 are provided in the side of the tank to allow cleaning of the tank. Exhaust gases pass from the housing 12 through openings 238 into a manifold 239 which opens into the top left portion of the tank 22 above the fluid 242. Pressure built up in the housing and suction created by the air pump blades 162 draw the gases between the baffles in and out of the fluid until the gases reach the end of the engine under the starter mechanism. Here, the gases either exit the engine through an exhaust pipe 244 or are drawn into the open end of the conduit 177 which extends from the mixer housing 173 into the tank 22 and through openings (not shown) in the upper baffles 241 to the starter end of the tank 22. Thus the exhaust gases will be cleaned and recirculated or exhausted as needed.

It will thus be seen that the present invention provides an improved internal combustion engine in which three double-acting pistons provide high pressure exhaust gases to drive a turbine, and in which operation of the pistons and starting of the engine are accomplished utilizing a unique control wheel system.

The disclosure of U.S. Pat. No. 4,344,288 is expressly incorporated herein by reference.

While this invention has been described in detail with reference to particular embodiments thereof, it will be understood that variations and modifications can be effected within the spirit and scope of the invention as described hereinbefore and as defined in the appended claims.

I claim:

1. An internal combustion engine comprising:

an engine block defining therein a central cylinder and a pair of auxiliary cylinders positioned on opposite sides of said central cylinder;

central double acting piston means slidably positioned within said central cylinder and a pair of auxiliary double acting piston means slidably positioned within said auxiliary cylinders;

coordinating gear means for interconnecting said central piston means to each of said auxiliary piston means and for limiting the sliding movement of said auxiliary piston means to reciprocation at the same speed in opposite direction to the sliding movement of said central piston means;

first circular gear means rotatably mounted about an axis passing through the center of said central piston means;

a pair of second circular gear means positioned to engage said first circular gear means; and a pair of articulated arm means, rigidly connected at one end thereof to one of said coordinating gear means and pivotally connected at the other end thereof to an eccentric point on one of said second circular gear means, for rotating said first circular gear means about said axis in response to operation of said piston means.

2. The engine of claim 1, further comprising spark means at each end of each of said cylinders, and further comprising means for timing the firing of said spark means comprising an oscillating cam fixed to rotate with said coordinating gear means, a plurality of sets of points, each corresponding to one of said spark means, said points being mounted adjacent to said cam such that a first group of said points is operated upon movement of said coordinating gear means in a first direction and a second group of said points is operated upon movement of said coordinating gear means in a second direction, and means for connecting said points to said corresponding spark means.

3. The engine of claim 2, further comprising at least one idler double sided pinion gear mounted upon an idler shaft positioned adjacent to one of said auxiliary piston means opposite said central piston means, said idler pinion gear engaging the racks of said one auxiliary piston means, and wherein said oscillating cam is fixed to rotate with said idler shaft.

4. The engine of claim 1, further comprising:

valve cam means mounted on the outer surface of said first circular gear means;

a valve stem associated with one of said cylinders;

valve actuator means pivotally attached to said engine block for engaging said valve cam means and engaging said valve stem in response to engagement of said valve cam means.

5. The engine of claim 1, further comprising starting means for selectively rotating said first circular gear means so as to rotate said pair of second circular gear means, and thereby reciprocating said arm means, said coordinating gears, and said piston means.

6. The engine of claim 1, further comprising turbine means surrounding said engine block; and means for directing exhaust gases from said cylinders onto said turbine means.

7. An internal combustion engine comprising:

an engine block defining therein a pair of parallel cylinders;

double acting piston means slidably positioned within said cylinders;

means interconnecting said piston means for limiting the sliding movement thereof within said cylinders to reciprocation at the same speed in opposite directions;

a cam mounted to oscillate with the motion of said interconnecting means;

spark means at each end of each of said cylinders; and a plurality of sets of points, each corresponding to one of said spark means, said points being mounted adjacent to said cam such that a first group of said points is operated upon movement of said cam in a first direction and a second group of said points is operated upon movement of said cam in a second direction.

8. An internal combustion engine comprising:

an engine block defining therein a pair of parallel cylinders;

double acting piston means slidably positioned within said cylinders;

means interconnecting said piston means for limiting the sliding movement thereof within said cylinders to reciprocation at the same speed in opposite directions;

a control wheel rotatably mounted about an axis passing between said piston means;

circular gear means for rotating said control wheel; and articulated arm means, rigidly connected at one end thereof to said interconnecting means and pivotally connected at the other end thereof to an eccentric point on said circular gear means, for rotating said control wheel about said axis in response to operation of said piston means.

* * * * *